US008935896B2

(12) United States Patent
Tancredi et al.

(10) Patent No.: US 8,935,896 B2
(45) Date of Patent: Jan. 20, 2015

(54) MASONRY SUPPORT PANEL AND ASSOCIATED METHODS OF USE

(71) Applicants: John Tancredi, Wyomissing, PA (US); John Cotton, Wyomissing, PA (US)

(72) Inventors: John Tancredi, Wyomissing, PA (US); John Cotton, Wyomissing, PA (US)

(73) Assignee: Glen-Gery Corporation, Wyomissing, PA (US)

( * ) Notice: Subject to any disclaimer, the term of this patent is extended or adjusted under 35 U.S.C. 154(b) by 0 days.

(21) Appl. No.: 13/766,932

(22) Filed: Feb. 14, 2013

(65) Prior Publication Data

US 2013/0247495 A1 Sep. 26, 2013

Related U.S. Application Data

(63) Continuation-in-part of application No. 12/729,966, filed on Mar. 23, 2010, now abandoned.

(60) Provisional application No. 61/210,758, filed on Mar. 23, 2009.

(51) Int. Cl.
*E04B 2/32* (2006.01)
*E04F 13/08* (2006.01)

(52) U.S. Cl.
CPC ..... *E04B 2/32* (2013.01); *E04F 13/0862* (2013.01)
USPC ..... 52/387; 52/302.1; 52/385; 52/389

(58) Field of Classification Search
USPC ..... 52/105, 302.1, 314, 315, 344, 389, 443, 52/444, 446, 449, 453, 555, 385–387
See application file for complete search history.

(56) References Cited

U.S. PATENT DOCUMENTS

| | | | | | |
|---|---|---|---|---|---|
| 777,656 | A | | 12/1904 | Banning | |
| 1,068,542 | A | | 7/1913 | Stewart | |
| 1,088,645 | A | | 2/1914 | Wilson | |
| 1,203,757 | A | | 11/1916 | Linkletter | |
| 1,277,622 | A | | 9/1918 | Madison | |
| 1,430,080 | A | | 9/1922 | Hicks | |
| 1,470,835 | A | | 10/1923 | Hathaway | |
| 1,485,370 | A | | 3/1924 | Cumfer | |
| 1,581,329 | A | | 4/1926 | Wilhelm | |
| 1,976,947 | A | | 10/1934 | Krauss | |
| 2,043,706 | A | * | 6/1936 | Myers | 52/387 |
| 2,054,511 | A | * | 9/1936 | Hornicek | 52/774 |
| 2,089,893 | A | | 8/1937 | Greulich | |
| 2,202,568 | A | * | 5/1940 | Worden | 52/387 |
| 2,300,258 | A | * | 10/1942 | Kublanow | 52/774 |
| 3,005,293 | A | * | 10/1961 | Hunter | 52/385 |

(Continued)

FOREIGN PATENT DOCUMENTS

| | | | | |
|---|---|---|---|---|
| GB | 2368855 A | * | 5/2002 | E04F 13/08 |
| JP | 05044270 A | * | 2/1993 | E04B 1/64 |

(Continued)

*Primary Examiner* — Robert Canfield
*Assistant Examiner* — Charissa Ahmad
(74) *Attorney, Agent, or Firm* — King & Partners, PLC

(57) ABSTRACT

Support panels for masonry objects and associated methods of use are disclosed herein. A support panel for masonry objects may include an inner surface, an outer surface, at least one stiffening channel formed longitudinally along the support panel, and a plurality of substantially C-shaped tabs extending from the outer surface, the tabs being disposed in spaced apart relation to one another to form a grid, wherein the tabs are configured to contactingly support at least a portion of a masonry object.

13 Claims, 9 Drawing Sheets

(56) References Cited

U.S. PATENT DOCUMENTS

| | | | | | |
|---|---|---|---|---|---|
| 3,019,560 | A | | 2/1962 | Hansen | |
| 3,220,151 | A | | 11/1965 | Goldman | |
| RE26,141 | E | | 1/1967 | Hickman | |
| 3,310,921 | A | | 3/1967 | Perez | |
| 3,322,287 | A | * | 5/1967 | Ragir | 211/87.01 |
| 3,374,589 | A | | 3/1968 | Neal, Jr. | |
| 3,533,206 | A | | 10/1970 | Passeno | |
| 3,621,625 | A | | 11/1971 | Medow | |
| 4,011,702 | A | | 3/1977 | Matyas | |
| 4,662,140 | A | | 5/1987 | Porter et al. | |
| 4,803,821 | A | | 2/1989 | Funaki | |
| 4,856,246 | A | | 8/1989 | Shimasaki | |
| 4,987,712 | A | * | 1/1991 | Mancuso | 52/387 |
| 5,052,161 | A | | 10/1991 | Whitacre | |
| D352,651 | S | | 11/1994 | Anderson et al. | |
| 5,489,462 | A | | 2/1996 | Sieber | |
| 5,822,937 | A | | 10/1998 | Mahony et al. | |
| 5,860,259 | A | | 1/1999 | Laska | |
| 5,860,261 | A | * | 1/1999 | LeBlanc | 52/385 |
| 6,098,363 | A | | 8/2000 | Yaguchi | |
| 6,256,955 | B1 | | 7/2001 | Lolley et al. | |
| 6,408,585 | B1 | * | 6/2002 | Tajima | 52/506.06 |
| 6,691,472 | B2 | | 2/2004 | Hubert | |
| D495,067 | S | | 8/2004 | Winig et al. | |
| 6,802,165 | B1 | | 10/2004 | Passeno | |
| 6,990,778 | B2 | | 1/2006 | Passeno | |
| D562,468 | S | | 2/2008 | Coulson | |
| 7,617,646 | B2 | | 11/2009 | Losse | |
| 7,743,569 | B1 | * | 6/2010 | Schwalenberg | 52/387 |
| 7,997,039 | B2 | | 8/2011 | Wolf et al. | |
| 8,042,309 | B2 | | 10/2011 | Wolf et al. | |
| 8,122,683 | B1 | | 2/2012 | Schwalenberg | |
| D663,044 | S | * | 7/2012 | Tancredi et al. | D25/121 |
| 2002/0139068 | A1 | | 10/2002 | Janesky | |
| 2003/0208978 | A1 | | 11/2003 | Chen | |
| 2004/0226238 | A1 | | 11/2004 | Haapiainen | |
| 2009/0193738 | A1 | | 8/2009 | Kortuem et al. | |
| 2010/0170179 | A1 | | 7/2010 | Stone | |

FOREIGN PATENT DOCUMENTS

| | | | | | |
|---|---|---|---|---|---|
| WO | WO 9305251 | A1 | * | 3/1993 | E04B 2/90 |
| WO | WO 2005100717 | A1 | * | 10/2005 | |

* cited by examiner

MASONRY SUPPORT PANEL AND ASSOCIATED METHODS OF USE

CROSS-REFERENCE TO RELATED APPLICATIONS

This application is a continuation-in-part of U.S. application Ser. No. 12/729,966, filed Mar. 23, 2010, entitled "SUPPORT PANEL FOR MASONRY," which claims the benefit of U.S. Provisional Application Ser. No. 61/210,758, filed Mar. 23, 2009, entitled "SUPPORT PANEL FOR MASONRY," which are hereby incorporated herein by reference in their entirety—including all references cited therein.

BACKGROUND OF THE INVENTION

1. Field of the Invention

The present invention relates in general to support panels for masonry objects and associated methods of use and, more particularly, but not by way of limitation, to support panels for masonry objects that are adapted to effectively reduce and/or eliminate pressure-induced fluid penetration through the masonry objects attached thereto. The present invention further relates to support panels that comprise one or more longitudinally displaced channels and/or comprise a plurality of substantially C-shaped tabs that emanate contiguously from the outer surfaces of the support panels.

2. Background Art

Support panels and structures have been known in the art for years, and are the subject of numerous patents, including: U.S. Pat. No. 8,122,683 entitled "Support Panel For Thin Brick," U.S. Pat. No. 8,042,309 entitled "Panelized Veneer With Backer-To-Backer Locators," U.S. Pat. No. 7,997,039 entitled "Veneer Panel," U.S. Pat. No. 7,617,646 entitled "Support Panel," U.S. Pat. No. 6,802,165 entitled "Thin Brick Panel Construction," U.S. Pat. No. 6,691,472 entitled "Foundation Wall Protector," U.S. Pat. No. 6,256,955 entitled "Apparatus And Method For Debris Collecting In Masonry Cavity Walls," U.S. Pat. No. 5,860,259 entitled "Masonry Insulated Board With Integral Drainage," U.S. Pat. No. 5,489,462 entitled "Distance Plate Building Component With A Protective, Ventilating, Heat-Insulating And Drainage Function," U.S. Pat. No. 4,856,246 entitled "Tile Assembly," U.S. Pat. No. 4,662,140 entitled "Brick Support Structure," U.S. Pat. No. 3,621,625 entitled "Brick Siding," and U.S. Pat. No. 1,277,622 entitled "Trussed-Sheet Building Material"—all of which are hereby incorporated herein by reference in their entirety including all references cited therein.

U.S. Pat. No. 8,122,683 appears to disclose a support panel for thin brick, comprising a metal sheet, an array of groove retaining tabs having first tab edges, the first tab edges protruding from the sheet having an upward angle of less than about 45 degrees, for a distance of less than about one quarter inch, and an array of mortar lock tabs having second tab edges, the second tab edges protruding from the sheet at a downward angle of greater than about 45 degrees, the array of mortar lock tabs being offset vertically from the array of groove retaining tabs, wherein, the array of groove retaining tabs are adapted to engage shallow dovetail grooves formed in the rear of thin bricks, and the mortar lock tabs are adapted, when embedded within a cured mortar matrix, to exert, in response to a tensile force away from the metal sheet, a force along a vertical axis, on the brick, in an opposite direction to a force applied to the brick along a vertical axis by the groove retaining tab, to thereby retain the brick against the panel.

U.S. Pat. No. 8,042,309 appears to disclose a cast veneer wall panel that includes a backing panel having a rear face and a front face. The front face includes a boundary wall and a continuous abutment extending around a perimeter of a casting field. The cast veneer wall panel further includes a facing panel formed from a cast material that is received and held within the casting field. The facing panel includes at least one design element.

U.S. Pat. No. 7,997,039 appears to disclose a cast veneer wall panel that includes a facing panel having at least one design element. The facing panel is made from a cast material. In addition the wall panel includes a backing panel including a series of spaced apertures. The series of spaced apertures receive a portion of the cast material in order to key the facing panel and the backing panel together.

U.S. Pat. No. 7,617,646 appears to disclose a support panel comprising a plate including a face, at least one row of support tabs and at least one row of L-shaped fingers. The at least one row of L-shaped fingers are located above at least one of the at least one row of support tabs. The L-shaped fingers include a first portion and a second portion defining the L-shape of the L-shaped fingers. A tile can be placed on at least one of the tabs and maintained in position by the second portion of at least one of the L-shaped fingers. Alternatively, the plate could include at least one row of upwardly and outwardly angled tongues for insertion into at least one angled slot in a rear face of a tile to maintain the tiles in position adjacent a front of the plate.

U.S. Pat. No. 6,802,165 appears to disclose a building block holder for securely holding thin bricks or other building blocks in a spaced relationship on a wall which comprises a panel formed of sheet material that is adapted to be fastened to the side of a building. The panel has rows of spaced block support elements in the form of stamped, inclined, V-shaped prongs that extend outwardly from the panel such that when the gap between the blocks is filled with mortar, the mortar flows behind the prongs and thereby locks the building blocks on the panel. The panel also includes glue lock openings behind the blocks for more securely locking the bricks to the panel. A plurality of rearwardly deformed portions on the panel space the panel outwardly from a substrate and serve as water drains and recessed locations through which mounting screws can be extended. A lower edge of the panel is displaced outwardly from a rear surface of the panel such that an upper edge of the panel below will fit behind the lower edge. The building block holder further includes a shelf for mounting elongated blocks on their ends, a corner element that fits on the corner of a building, an outwardly extending flange that runs along the lower end of the panel, and a J-shaped panel edge connection.

U.S. Pat. No. 6,691,472 appears to disclose a foundation protector for a foundation wall that prevents moisture from being retained in the foundation wall and also provides drainage for surface water so that water does not rest against the surface of the foundation wall. The foundation protector has a smooth exterior surface so that it remains attached to the foundation if earth subsidence occurs. The foundation protector includes a waterproof dimpled sheet with spaced apart protrusions and an outer waterproof membrane which covers recesses formed by the protrusions and provides a substantially smooth exterior surface.

U.S. Pat. No. 6,256,955 appears to disclose a mesh device for retaining mortar and other debris within a mortar-cavity-wall so as to prevent such material from falling in front of and hence blocking the "weep holes" placed at the bottom of such a wall to permit the egress of moisture condensate that forms within this type of wall. The device of the present invention is a rectangle of thin, openly woven mesh of basically a planar shape but with bumps distributed across the plane in such a manner that when the device is placed upright within the cavity the bumps form barriers to the dropping of mortar and other debris. The bumps themselves, being made of the same material as the rest of the device, are fully permeable to moisture working its way down the cavity. Furthermore, there is an offset of the bumps in one row from those in the next so as to further reduce the possibility of a blockage occurring, for example, by debris accumulated on the bumps. Finally, the bumps on one side of the planar surface are matched by dimples on the other side. This permits nesting of the individual devices, thus reducing the space that the units take up during transportation and storage.

U.S. Pat. No. 5,860,259 appears to disclose an insulated drainage panel for use in cavity wall or veneer wall construction. The insulated panel includes a generally planar insulating board, and a porous structure disposed on one side of the board.

U.S. Pat. No. 5,489,462 appears to disclose a building component in the form of a board-like distance plate having a lattice of horizontal and vertical ribs. Frustopyramid projections extend from the intersections of the ribs on one side of the board and domes extend from the other side of the board between the ribs and cover a larger surface area than the projections. The domes form cavities which are interconnected by virtue of the projections spacing the plate from a wall or other surface.

U.S. Pat. No. 4,856,246 appears to disclose a tile assembly comprising a tile support plate having a plurality of vertical brackets erected at right angles and provided with a hook portion and a plurality of tiles having on its backside a groove with an upper engaging edge for engaging at least a pair of the hook portions, thereby securing the tile to the support plate.

U.S. Pat. No. 4,662,140 appears to disclose a masonry/brick support structure that is adapted for secure positioning upon a substructure such as a wall and includes a sheet metal underlayer or panel having a plurality of tabs punched therein and extending outward from a first side thereof. Also positioned on the first side of the sheet metal panel are adhesive strips for permanently affixing bricks to the panel's first, or outer, side with the bricks positioned in a given spaced array on the panel by the tabs extending therefrom. The tabs may be incorporated in the sheet metal panel in virtually any array to allow for a wide range of brick shapes and dimensions as well as various brick alignment arrangements. The tabs provide support for the bricks when initially positioned upon the panel. Mortar or grout is positioned in the inter-brick spaces and over the tabs which are thus no longer visible. The first, outer surface of the sheet metal panel may also be provided with an appropriate adhesive layer for maintaining the mortar or grout applied thereto securely in position after it sets. The sheet metal panel may be provided on a second, inner surface thereof with an insulating layer such as a foam insulation which is maintained thereon by an appropriate adhesive layer to form an insulated building structure.

U.S. Pat. No. 3,621,625 appears to disclose brick siding for covering building walls simulating antique, used or old brick consisting of a plurality of rectangular sheets of fiberglass fastened to the wall with each horizontal row of sheets positioned in overlapping relation with the adjacent row, each sheet having formed thereon to simulate row of old bricks having chips, distress marks and the like thereon. In order to achieve authentic appearance that is in keeping with the aesthetics of proper masonry practices, the end bricks on alternate rows along one side of each sheet are grooved to receive the end portion of the bricks of an adjacent sheet so that these bricks appear to span the mortar joint of the adjacent rows of bricks, the tongue and groove bricks, when joined appear as a single brick having a distress mark.

U.S. Pat. No. 1,277,622 appears to disclose a building material for walls, partitions, flooring, ceilings, roofs, and the like, and provides truss sheet construction which appears to be fire-proof, heat-insulating, sound proof, and of light weight, but at the same time strong and durable and adapted to carry heavy loads.

While the above-identified references do appear to provide support panels and structures for masonry objects, their configurations remain non-desirous and/or problematic inasmuch as, among other things, none of the above-identified panels and supports appear to disclose a support panel for masonry objects that are adapted to effectively reduce and/or eliminate pressure-induced fluid penetration through the masonry objects attached thereto—among other things.

It is therefore an object of the present invention to provide support panels for masonry objects, which, among other things, remedies the aforementioned detriments and/or complications associated with the use of the above-identified, conventional support structures or panels.

These and other objects of the present invention will become apparent in light of the present specification, claims, and drawings.

SUMMARY OF THE INVENTION

The present invention is directed to a support panel for masonry objects, comprising: (a) an inner surface; (b) an outer surface; (c) at least one stiffening channel formed longitudinally along the support panel; (d) a plurality of substantially C-shaped tabs extending from the outer surface, the tabs being disposed in spaced apart relation to one another to form a grid, wherein the tabs are configured to contactingly support at least a portion of a masonry object; and (e) wherein the support panel is attachable to a wall of a structure via at least one fastener inserted into the at least one stiffening channel into the wall of the structure such that the panel is spaced apart from the wall of the structure.

In a preferred embodiment of the present invention, the at least one stiffening channel is disposed between two columns of substantially C-shaped tabs.

In another preferred embodiment of the present invention, the at least one stiffening channel is substantially U-shaped and includes a substantially flattened medial portion that is disposed substantially parallel to the outer surface of the support panel.

In yet another preferred embodiment of the present invention, the substantially flattened medial portion of the at least one stiffening channel is adapted to receive at least one fastener for joining the support panel to the wall of the structure, wherein the support panel and the wall cooperate to form a conduit between adjacent stiffening channels. In this embodiment, each one of the substantially C-shaped tabs are preferably at least partially cutout from the support panel and bent outwardly to define a substantially hemispherical aperture adapted to communicate fluids through the support panel into the conduits between adjacent stiffening channels.

In another aspect of the present invention, the substantially C-shaped tabs are arranged into a plurality of rows, wherein vertically adjacent rows are spaced apart from one another to receive and support a masonry object therebetween, and wherein a bottom surface of each masonry object is contactingly supported by at least one substantially C-shaped tab disposed below the masonry objects. In this embodiment, the vertically adjacent rows are preferably spaced apart from one another such that when masonry objects are received and supported therein, voids are formed between vertically adjacent masonry objects. The voids are preferably at least partially filled with, for example, a bonding agent.

In one embodiment of the present invention, at least a portion of at least one of the inner surface and the outer surface of the support panel includes texturing.

In another preferred embodiment of the present invention, the plurality of substantially C-shaped tabs extend upward from the outer surface at approximately at least a 75 degree angle.

The present invention is also directed to a method for installing masonry objects, comprising the steps of: (a) attaching one or more support panels for masonry objects to a wall of a structure, each of the support panels comprising: an inner surface; an outer surface; at least one stiffening channel formed longitudinally along the support panel; a plurality of substantially C-shaped tabs extending from the outer surface, the tabs being arranged into rows and disposed in spaced apart relation to one another to form a grid, wherein the tabs are configured to contactingly support at least a portion of a masonry object, wherein vertically adjacent rows are spaced apart from one another to receive and support a masonry object therebetween; and wherein the support panel is attached to the wall of the structure via at least one fastener inserted into the at least one stiffening channel into the wall of the structure such that the panel is spaced apart from the wall of the structure; (b) bonding masonry objects to the support panel such that the masonry objects are supported below by one or more substantially C-shaped tabs and such that voids are formed between vertically and horizontally adjacent masonry objects; and (c) filling at least a portion of the voids with a bonding agent.

In a preferred embodiment of the present invention, the at least one stiffening channel is substantially U-shaped and includes a substantially flattened medial portion that is disposed substantially parallel to the outer surface of the support panel.

In another preferred embodiment of the present invention, the substantially flattened medial portion of the at least one stiffening channel is adapted to receive at least one fastener to join the support panel to the wall of the structure, wherein the support panel and the wall cooperate to form a conduit between adjacent stiffening channels.

In yet another preferred embodiment of the present invention, each one of the substantially C-shaped tabs are at least partially cutout from the support panel and bent outwardly to define a substantially hemispherical aperture adapted to communicate fluids through the support panel into the conduits between adjacent stiffening channels, further wherein each of the substantially C-shaped tabs includes opposing arms that define an opening therebetween.

In one embodiment of the present invention, the method further comprises the step of installing a flashing along a bottom portion of the wall before attaching the one or more support panels to the wall.

In another aspect of the invention, the support panel is spaced above the flashing to form a gap adapted to allow air flow through an opening of each substantially C-shaped tab of a lower row, into the substantially hemispherical apertures of each tab, and upwardly into the conduits between adjacent stiffening channels.

In a preferred embodiment of the present invention, the substantially C-shaped tabs are bent outwardly from the outer surface of the support panel to form an angle of approximately 75 degrees with the outer surface of the support panel.

In another preferred embodiment of the present invention, the method further comprises the step of attaching a layer of insulation to the wall before attaching the one or more support panels.

In one embodiment of the present invention, the step of bonding includes applying a predetermined amount of bonding agent to at least a portion of a rear surface of each masonry object before applying the masonry object to the outer surface of the support panel.

In a preferred embodiment of the present invention, the step of bonding includes applying a predetermined amount of bonding agent to each of four corners of each masonry object before applying the masonry object to the outer surface of the support panel such that the masonry object is spaced apart from the top surface of the support panel.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
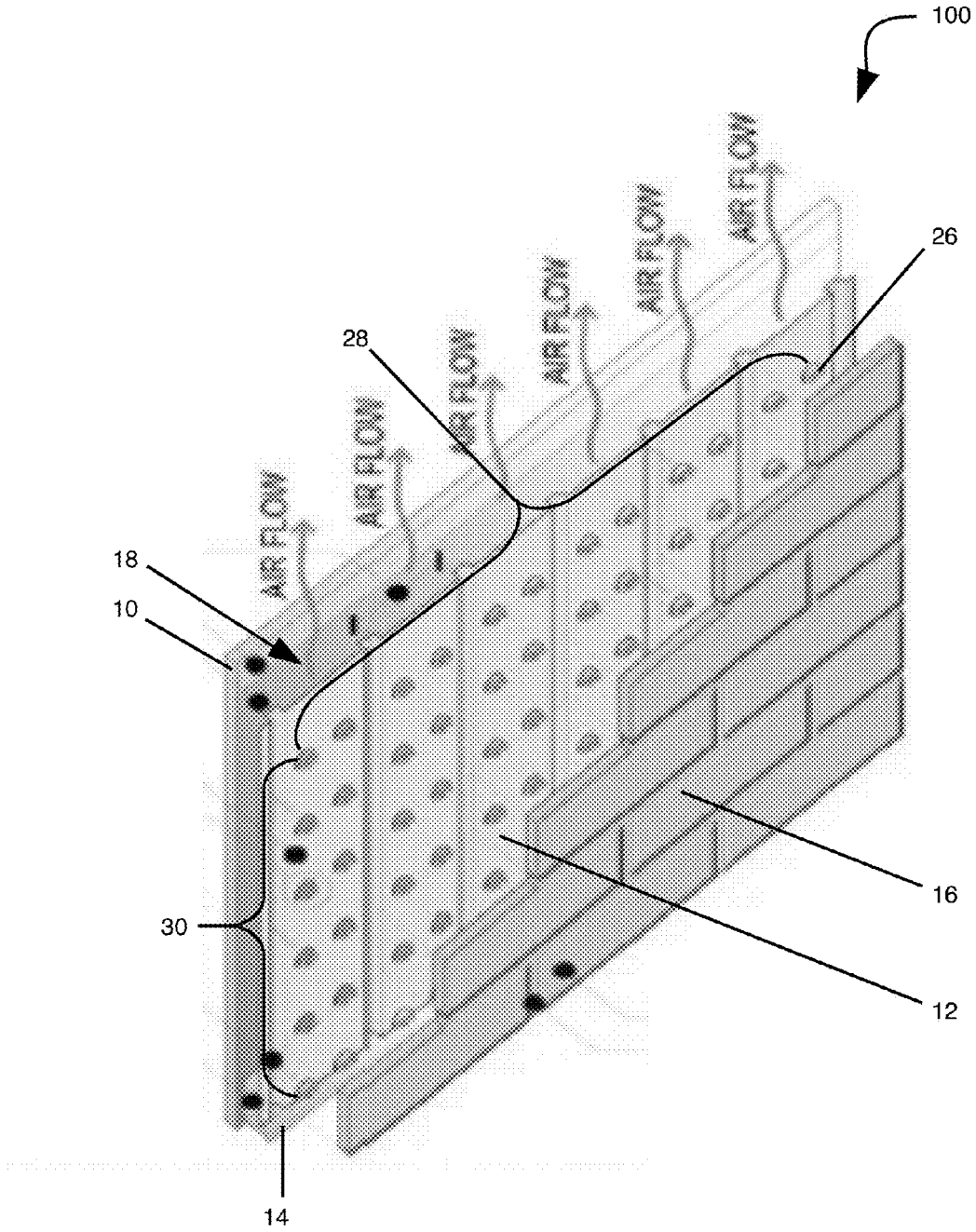
FIG. 1 of the drawings is an exploded perspective view of an exemplary environment illustrating the installation of a support panel for masonry objects.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Figure 2:
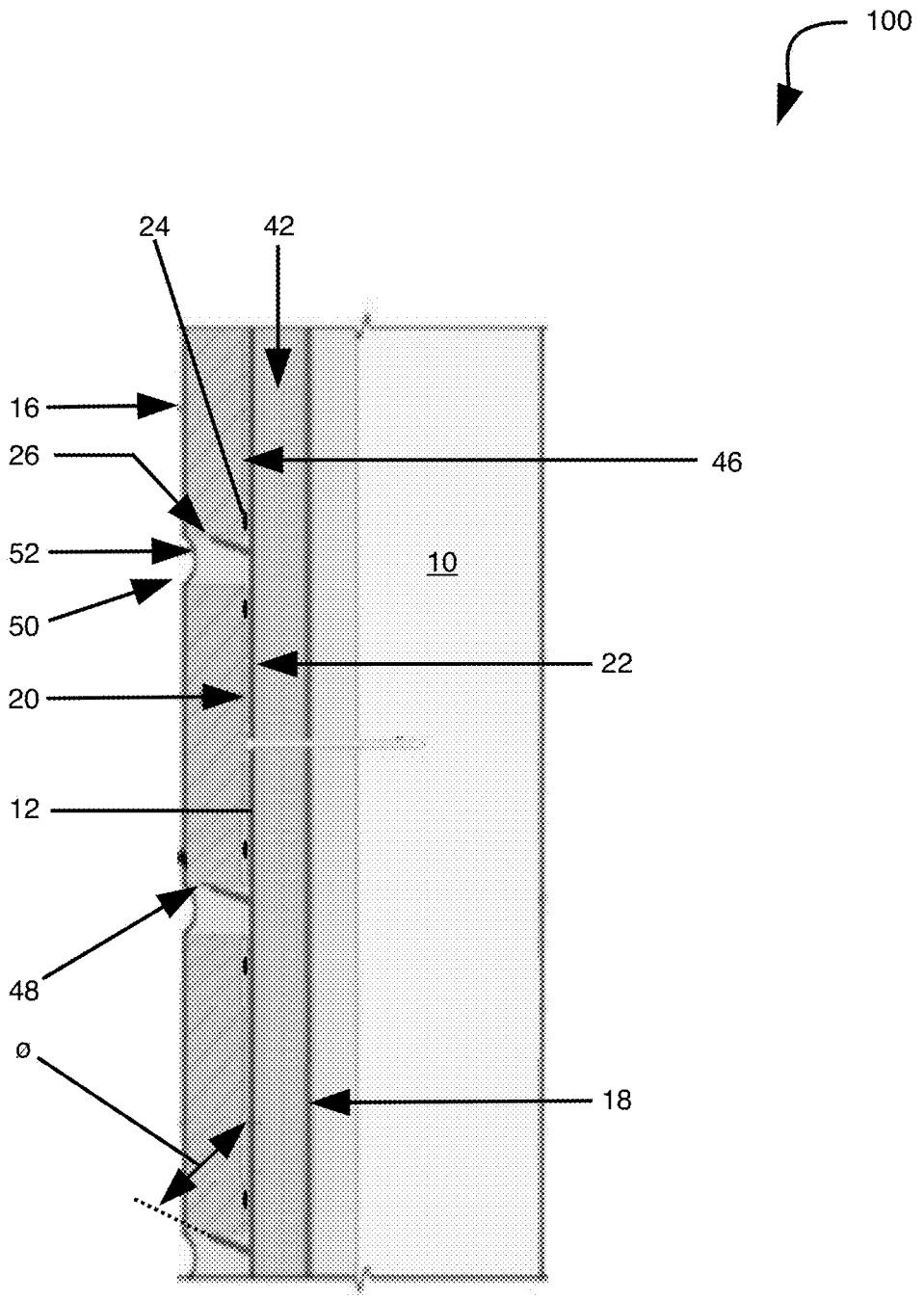
FIG. 2 of the drawings is a cross-sectional view of a support panel in combination with masonry objects, the support panel installed on the wall of a structure.

Referring now to the drawings, and more particularly to FIGS. 1 and 2 collectively, an exploded perspective view of exemplary environment 100 is shown. Environment 100 preferably includes wall 10, support panel 12, flashing 14, and masonry objects 16. According to some embodiments, membrane 18 may be disposed between wall 10 and support panel 12 to act as an insulating and/or moisture barrier for protecting wall 10. Although not shown, a layer of insulation may be disposed between wall 10 and support panel 12, either alone or in combination with membrane 18.

It will be understood that wall 10 may include any one of a number of substrates such as plywood, concrete, cinderblock, stucco, wood slats, and the like.

Flashing 14 may be installed proximate the lower end of wall 10. Flashing 14 may be a substantially L-shaped elongated member that is adapted to be installed such that at least a portion of membrane 18 overlaps at least a portion of flashing 14 contacting wall 10. Fluid contacting membrane 18 is preferably directed downwardly via gravity and diverted away from wall 10 via flashing 14. It will be understood that in some embodiments, support panel 12 may be spaced apart from flashing 14 so as to create a gap between the end of support panel 12 and flashing 14 allowing fluid to communicate outwardly and away from wall 10 rather than being retained behind support panel 12, as will be discussed in greater detail infra.

Support panel 12 may be fabricated from, for example, a 27-gauge architectural grade steel panel. According to some embodiments, the size of support panel 12 may be nominally 48 inches by 48 inches, although it is envisioned to be within the scope of the present invention to form support panels 12 having different sizes and utilizing different gauge steel. According to some embodiments, support panel 12 may be formed from a plastic, a polymer, a resin, a composite, a natural product such as wood, rubber, or any combinations thereof.

It is noteworthy that in some embodiments, at least one of outer surface 20 and inner surface 22 of support panel 12 may be at least partially provided with a coating (not shown) such as a paint, powder coating, sealant, resin, and the like, adapted to substantially reduce or eliminate oxidation of support panel 12. One of ordinary skill in the art with the present disclosure before them will appreciate that the coating chosen may depend, in part, upon the material from which support panel 12 is fabricated.

According to additional embodiments, at least one of outer surface 20 and inner surface 22 may include texturing (not shown) adapted to further enhance the bond between support panel 12 and masonry objects 16 via adhesive 24 applied to at least one of support panel 12 and masonry objects 16.

Support panel 12 may include a plurality of substantially C-shaped tabs 26 that are formed during fabrication of support panel 12. Tabs 26 may be arranged into a grid having a plurality of rows 28 and columns 30.

It will be understood that when support panel 12 is fabricated, each tab 26 may be created via punching and/or laser cutting, and the like leaving tabs 26 at least partially connected to support panel 12. Therefore, tabs 26 are initially coplanar with the rest of support panel 12 until tabs 26 are bent outwardly so as to extend at an angle ø relative to outer surface 20. According to some embodiments, angle ø may include approximately 76 degrees relative to outer surface 20 of support panel 12, although one of ordinary skill in the art will appreciate that other angles may be utilized in accordance with the present invention—including, but not limited to, 30, 35, 40, 45, 50, 55, 60, 65, 70, 75, 80, 85, and 90 degrees.

Figure 3A:
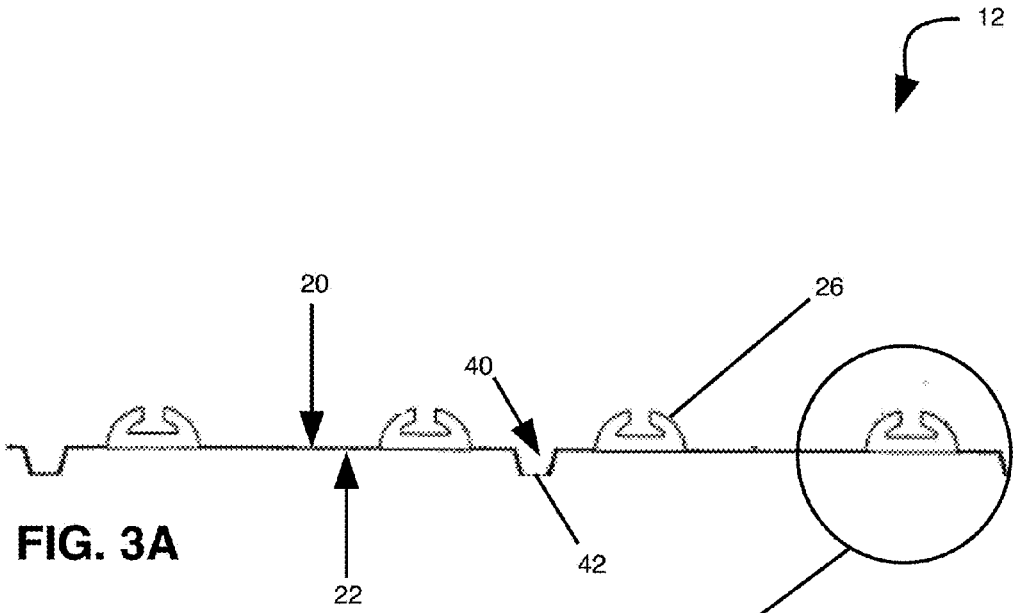
FIG. 3A of the drawings is a top plan view of a support panel for masonry objects.
Figure 3B:
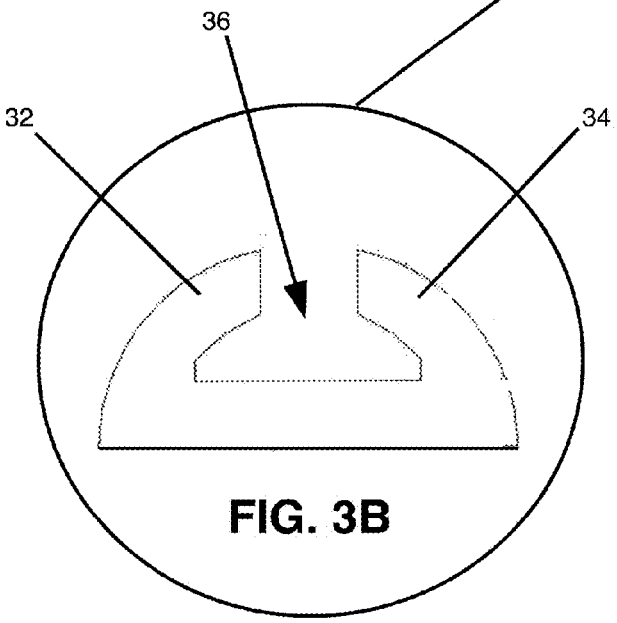
FIG. 3B of the drawings is a top plan view of a substantially C-shaped tab.
Figure 4:
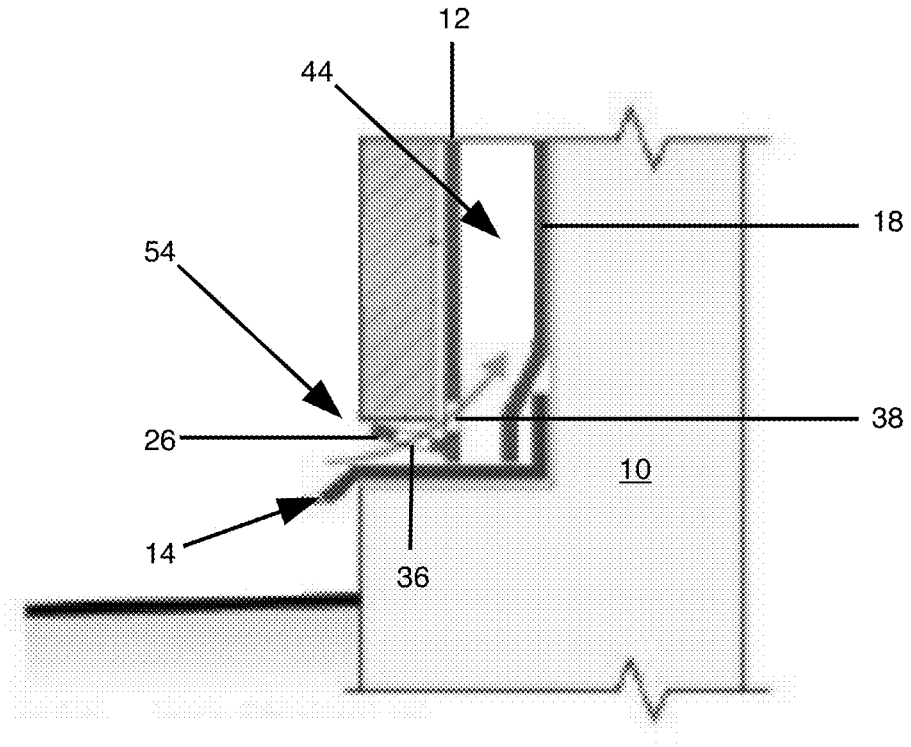
FIG. 4 of the drawings is a cross-sectional view of a lower end of the support panel spaced apart from a flashing.
Figure 5:
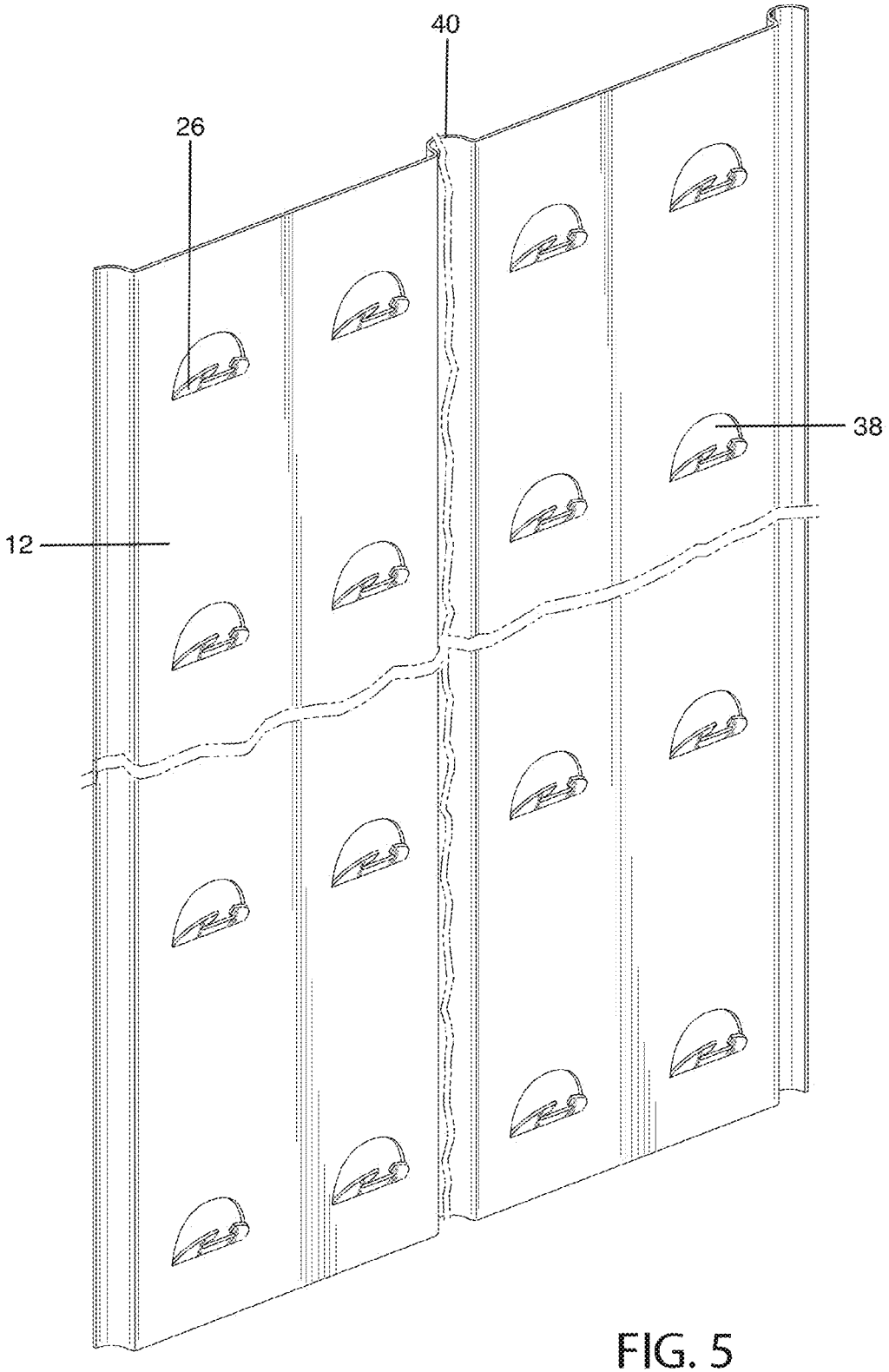
FIG. 5 is a front perspective view of one embodiment of a support panel fabricated in accordance with the present invention.
Figure 6:
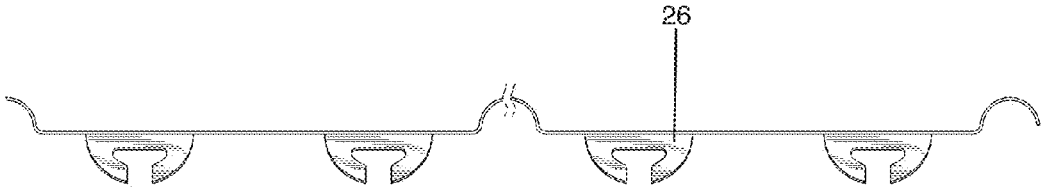
FIG. 6 is a top plan view of the support panel of FIG. 5.
Figure 7:
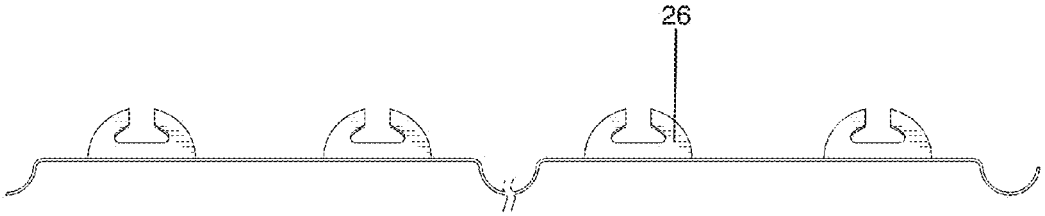
FIG. 7 is a bottom plan view of the support panel of FIG. 5.
Figure 8:
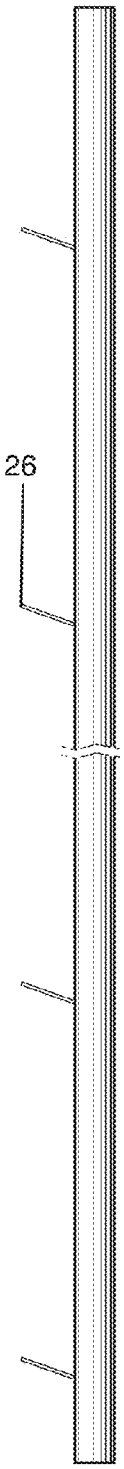
FIG. 8 is a left side elevation view of the support panel of FIG. 5.
Figure 9:
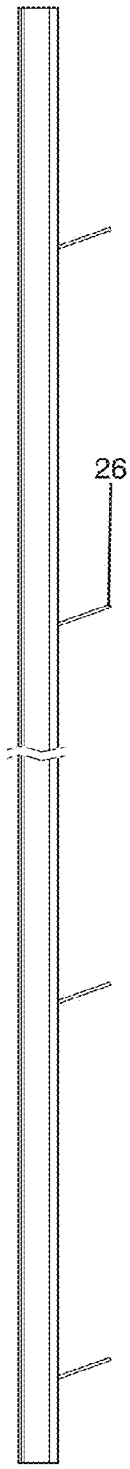
FIG. 9 is a right side elevation view of the support panel of FIG. 5.
Figure 10:
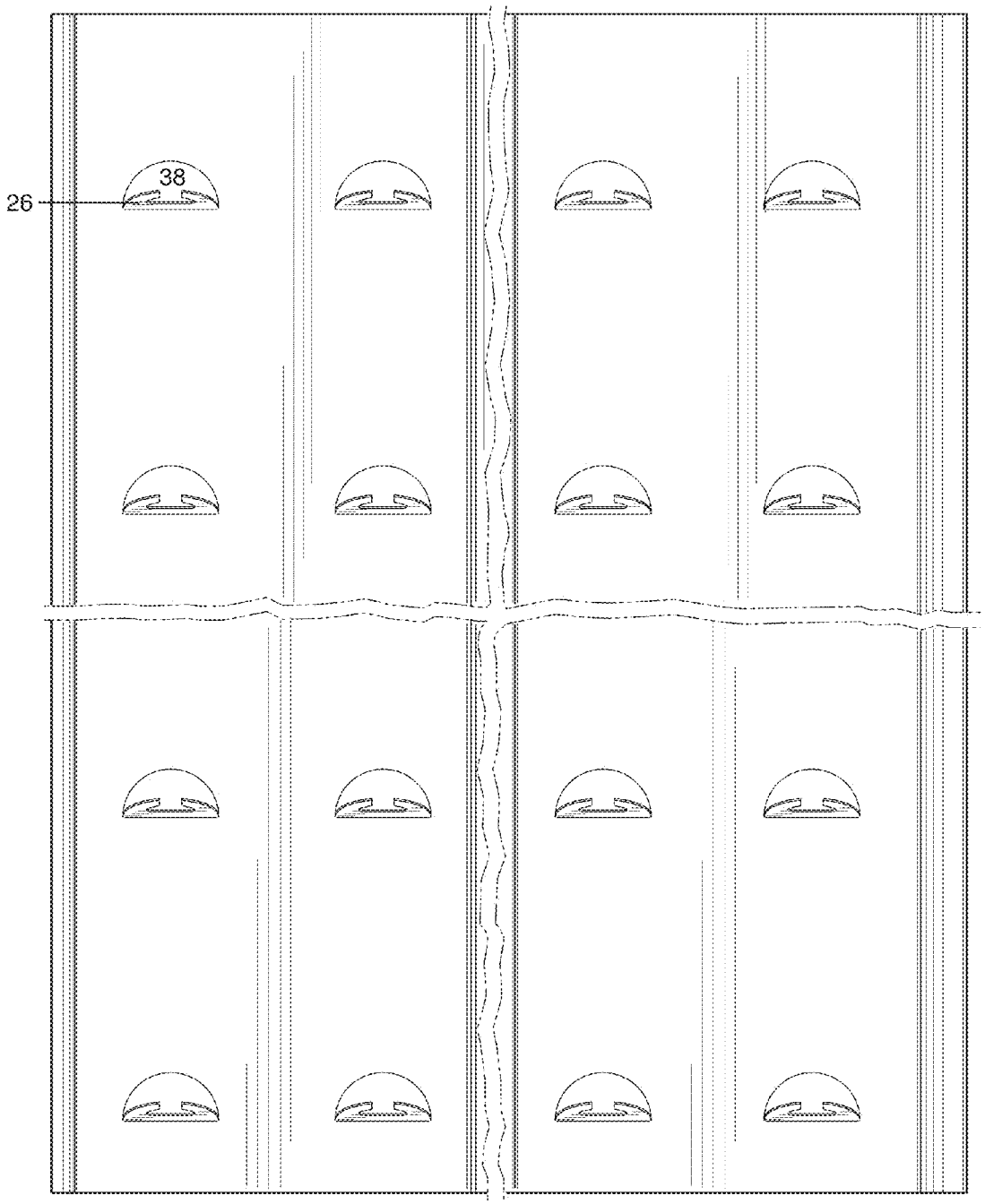
FIG. 10 is a front end view of the support panel of FIG. 5.
Figure 11:
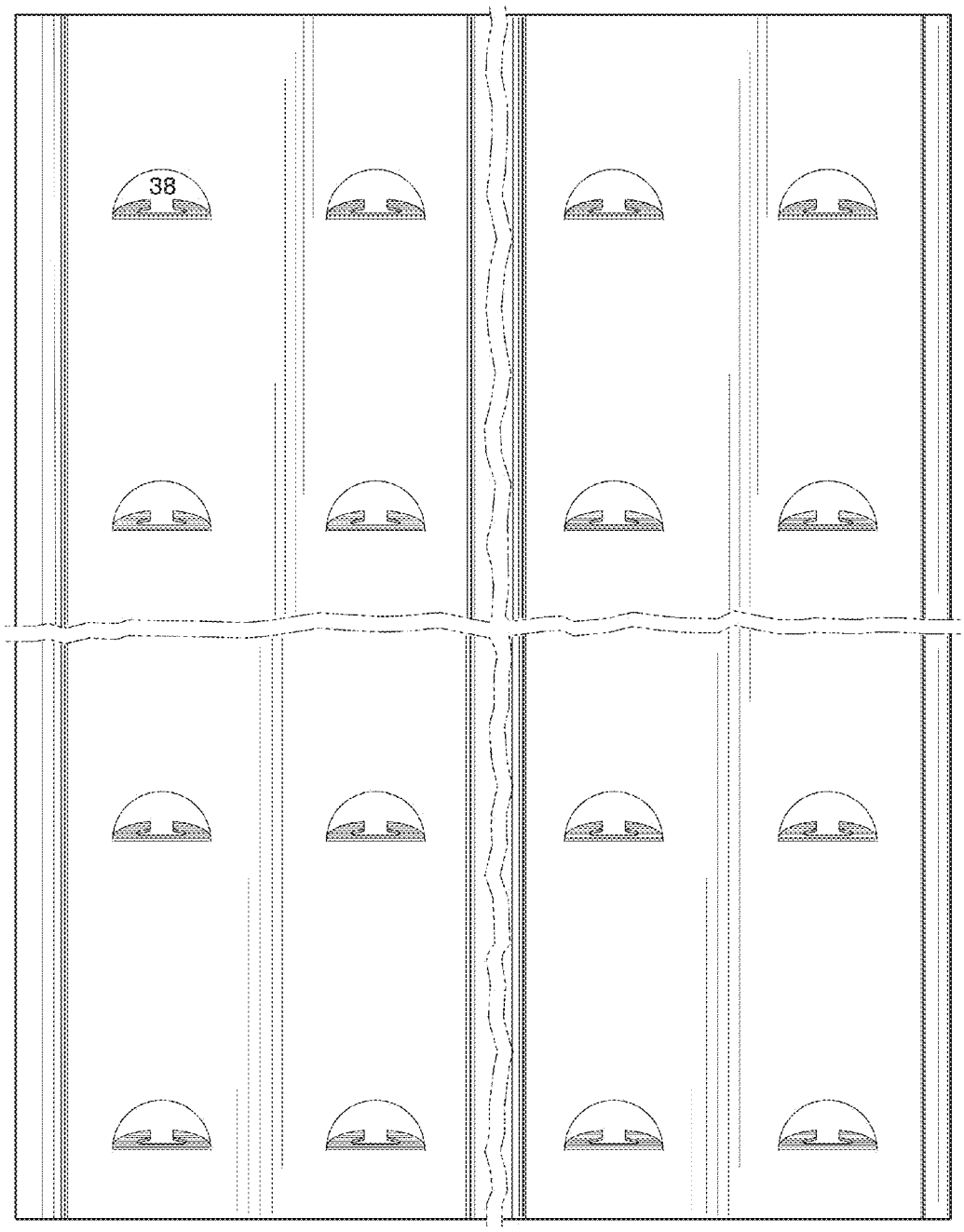
FIG. 11 is a rear end view of the support panel of FIG. 5.

Referring now to FIGS. 3A, 3B, and 4 collectively, each tab 26 includes a particular geometrical configuration that in some embodiments may include opposing arms 32 and 34 that are mirror images of one another and cooperate to define opening 36 that functions as a pathway for the communication of fluid, as will be discussed in greater detail infra. Moreover, as each tab 26 is bent outwardly, a substantially hemispherical aperture 38 (see FIG. 5) is left that corresponds in size to the outer peripheral geometry of tab 26.

Support panel 12 may also include a plurality of stiffening ribs 40 that extend longitudinally along the length of support panel 12 from top to bottom. Ribs 40 are formed integrally and preferably comprise a substantially U-shaped configuration that optionally includes substantially flat medial portion 42. Medial portion 42 may be substantially parallel to outer surface 20 of support panel 12 and functions as a level contact surface for attaching support panel 12 to wall 10. Moreover, support panel 12 may be securely attached to wall 10 via fasteners inserted through ribs 40. In some embodiments, ribs 40 may include apertures (not shown) adapted to receive any one of a number of fasteners such as nails, screws, pins, clips, or the like. It is noteworthy that fasteners may be fabricated from a substantially non-corrosive and/or non-reactive material such as stainless steel.

According to some embodiments, support panel 12 may include a plurality of ribs 40, each rib 40 subdividing tabs 26 into columns 30 of two, although it will be understood that ribs 40 may subdivide tabs 26 into columns 30 of varying numbers.

As is best shown in FIG. 4, when support panel 12 is attached to wall 10, sections of support panel 12 between ribs 40 are spaced apart from wall 10 to form conduits 44 that are adapted to facilitate the communication of fluids therethrough.

Masonry objects 16 may be substantially cuboid in configuration, resembling a traditionally proportioned brick, but having smaller thickness than a traditional brick. Among other surfaces, masonry object 16 includes rear surface 46 and bottom surface 48 (see FIG. 2). It will be understood that bottom surface 48 of masonry objects 16 may contactingly rest upon at least a portion of one or more tabs 26.

Adhesive 24 may be applied to at least a portion of rear surface 46 of masonry objects 16. According to some embodiments, adhesive 24 may include any number of products capable of bonding masonry objects 16 to support panel 12.

It will be understood that the spacing of vertically adjacent rows 28 of tabs 26 and the horizontal spacing of laterally adjacent masonry objects 16 form voids 50 adapted to receive bonding agent 52 therein. According to some embodiments, bonding agent 52 may include, for example, concrete, mortar, grout, adhesive, resin, or combinations thereof. It is noteworthy that bonding agent 52 disposed within voids 50 operates to bond adjacent masonry objects 16 together to create a facade that covers at least a portion of the outer surface of support panel 12.

Generally speaking, the force generated by air directed against the outer surface of a brick wall may drive moisture between any spaces that may exist between masonry objects 16 and bonding agent 52, cracks that may exist in bonding agent 52 or masonry objects 16, and the like. As such, conduits 44 function to regulate the pressure across the outer surface of the facade of masonry objects 16 to prevent moisture from being driven inwardly through any imperfections in the facade of masonry objects 16.

Referring now to FIG. 4, support panel 12 may be spaced apart from flashing 14 such that gap 54 is formed therebetween. Lower row 28 of tabs 26 are exposed along gap 54 such that air flowing into gap 54 communicates through openings 36 of tabs 26, into apertures 38, passing upwardly into conduits 44, and ultimately out of conduits 44 into the soffit, eave, or ceiling of the structure (not shown). Therefore, the pressure of the air flowing through conduits 44 is substantially equal to the pressure of the air contacting the outer surface of the facade of masonry objects 16. Moreover, as support panel 12 is spaced apart from flashing 14, any fluids that may build up behind masonry objects 16 may pass through apertures 38, downwardly through conduits 44, and outwardly from wall 10 via flashing 14.

In operation, flashing 14 may be securely attached to the lower end of wall 10 such that at least a portion of flashing 14 contacting wall 10 is covered by membrane 18. One or more support panels 12 may be securely attached to wall 10 via fasteners inserted through ribs 40. According to some embodiments, support panels 12 may be spaced apart from flashing 14 to form gap 54. It will be understood that all, or at least a portion of tabs 26 of support panels 12 may be bent outwardly before support panels 12 are secured to wall 10.

Once support panels 12 are secured to wall 10, a predetermined amount of adhesive 24 may applied to rear surface 46 of masonry objects 16 during installation. Adhesive 24 may be applied to only a portion of rear surface 46 of masonry objects 16 such as the four corners of masonry objects 16. Masonry objects 16 are applied to outer surface 20 of support panels 12 within spaces between vertically adjacent rows 28 of tabs 26. It will be understood that application of adhesive 24 between outer surface 20 and masonry objects 16 preferably creates a space therebetween. As adhesive 24 may only be applied to a portion of rear surface 46 of masonry objects 16, fluid building up between masonry objects 16 and support panel 12 may communicate through apertures 38 and into conduits 44.

Additionally, bottom surface 48 of masonry objects 16 may contact at least a portion of one or more tabs 26 disposed on the lower row such that masonry objects 16 are supported thereby. The vertical and horizontal spacing of adjacent masonry objects 16 form voids 50 adapted to receive a predetermined amount of bonding agent 52 therein.

Referring now to FIGS. 5-11, additional views of support panels 12 are shown in accordance with the present invention.

The foregoing description merely explains and illustrates the invention, and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A support panel for masonry objects, comprising:
an inner surface;
an outer surface;
at least one stiffening channel formed vertically along the support panel;
a plurality of substantially C-shaped tabs extending from the outer surface, wherein the plurality of substantially C-shaped tabs are planar, and disposed in a spaced apart relation to one another to form a grid, wherein the plurality of substantially C-shaped tabs are configured to contactingly support at least a portion of a masonry object, wherein the plurality of substantially C-shaped tabs are at least partially cutout from the support panel and bent outwardly to define an aperture adapted to communicate fluids through the support panel into conduits between adjacent stiffening channels, and wherein the aperture consists of a hemispherical aperture; and
wherein the support panel is attachable to a wall of a structure via at least one fastener inserted into the at least one stiffening channel into the wall of the structure such that the panel is spaced apart from the wall of the structure.

2. The support panel according to claim 1, wherein the at least one stiffening channel is disposed between two columns of substantially C-shaped tabs.

3. The support panel according to claim 2, wherein the at least one stiffening channel is substantially U-shaped and includes a substantially flattened medial portion that is disposed substantially parallel to the outer surface of the support panel.

4. The support panel according to claim 3, wherein the substantially flattened medial portion of the at least one stiffening channel is adapted to receive at least one fastener for joining the support panel to the wall of the structure, wherein the support panel and the wall cooperate to form a conduit between adjacent stiffening channels.

5. The support panel according to claim 4, wherein each one of the substantially C-shaped tabs are cutout from the support panel and bent outwardly to define an aperture adapted to communicate fluids through the support panel into conduits between adjacent stiffening channels.

6. The support panel according to claim 5, wherein the plurality of substantially C-shaped tabs are arranged into a plurality of rows, wherein vertically adjacent rows are spaced apart from one another to receive and support a masonry object therebetween, wherein a bottom surface of each masonry object is contactingly supported by at least one of the plurality of substantially C-shaped tabs disposed below the masonry object, and wherein a top surface of each masonry object does not contact any one of the plurality of substantially C-shaped tabs positioned above the masonry object.

7. The support panel according to claim 6, wherein vertically adjacent rows are spaced apart from one another such that when masonry objects are received and supported therein, voids are formed between vertically adjacent masonry objects.

8. The support panel according to claim 7, wherein the voids are at least partially filled with a bonding agent.

9. The support panel according to claim 8, wherein at least a portion of at least one of the inner surface and the outer surface of the support panel includes texturing.

10. The support panel according to claim 9, wherein the plurality of substantially C-shaped tabs extend upward from the outer surface at approximately at least a 75 degree angle.

11. The support panel according to claim 10, wherein the plurality of substantially C-shaped tabs comprise opposing arms that are mirror images of one another and cooperate to define an opening that functions as a pathway for the communication of fluid.

12. A support panel for masonry objects, comprising:
an inner surface;
an outer surface;
at least one stiffening channel formed vertically along the support panel;
a plurality of substantially C-shaped tabs extending from the outer surface, wherein the plurality of substantially C-shaped tabs are planar, and disposed in a spaced apart relation to one another to form a grid, wherein the plurality of substantially C-shaped tabs are configured to contactingly support at least a portion of a masonry object, wherein the plurality of substantially C-shaped tabs comprise opposing arms that are mirror images of one another and cooperate to define an opening that functions as a pathway for the communication of fluid, wherein the plurality of substantially C-shaped tabs are at least partially cutout from the support panel and bent outwardly to define an aperture adapted to communicate fluids through the support panel into conduits between adjacent stiffening channels, and wherein the aperture comprises a hemispherical aperture; and wherein the support panel is attachable to a wall of a structure via at least one fastener inserted into the at least one stiffening channel into the wall of the structure such that the panel is spaced apart from the wall of the structure.

13. A support panel for masonry objects, consisting of:

an inner surface;

an outer surface;

at least one stiffening channel formed vertically along the support panel;

a plurality of substantially C-shaped tabs extending from the outer surface, wherein the plurality of substantially C-shaped tabs are planar, and disposed in a spaced apart relation to one another to form a grid, wherein the plurality of substantially C-shaped tabs are configured to contactingly support at least a portion of a masonry object, wherein the plurality of substantially C-shaped tabs comprise opposing arms that are mirror images of one another and cooperate to define an opening that functions as a pathway for the communication of fluid, wherein the plurality of substantially C-shaped tabs are at least partially cutout from the support panel and bent outwardly to define an aperture adapted to communicate fluids through the support panel into conduits between adjacent stiffening channels, and wherein the aperture consists of a hemispherical aperture; and wherein the support panel is attachable to a wall of a structure via at least one fastener inserted into the at least one stiffening channel into the wall of the structure such that the panel is spaced apart from the wall of the structure.

* * * * *